US006361037B1

(12) United States Patent
Nakagawa

(10) Patent No.: US 6,361,037 B1
(45) Date of Patent: Mar. 26, 2002

(54) SHEET FEEDING APPARATUS, IMAGE READING APPARATUS AND IMAGE FORMING APPARATUS

(75) Inventor: Daigo Nakagawa, Toride (JP)

(73) Assignee: Canon Kabushiki Kaisha, Tokoy (JP)

( * ) Notice: Subject to any disclaimer, the term of this patent is extended or adjusted under 35 U.S.C. 154(b) by 0 days.

(21) Appl. No.: 09/625,852

(22) Filed: Jul. 26, 2000

(30) Foreign Application Priority Data

Jul. 29, 1999 (JP) ..... 11-214577
Jul. 4, 2000 (JP) ..... 2000-201870

(51) Int. Cl.[7] ..... B65H 5/00

(52) U.S. Cl. ..... 271/10.11; 271/121; 271/124

(58) Field of Search ..... 271/10.01, 10.09, 271/10.11, 121, 124

(56) References Cited

U.S. PATENT DOCUMENTS 5,915,684 A 6/1999 Nakagawa et al. ..... 271/110
6,152,442 A * 11/2000 Nishinohara et al. ..... 271/121

* cited by examiner

*Primary Examiner*—David H. Bollinger
(74) *Attorney, Agent, or Firm*—Fitzpatrick, Cella, Harper & Scinto

(57) ABSTRACT

A sheet feeding apparatus having a stocking plate on which a plurality of sheets are stackable, a separating device for separating the sheets stacked on the stocking plate one by one by a pair of pressure contact members, a feeding device for feeding the sheets, and a pressure releasing device for releasing the pressure contact of the pair of pressure contact members has a returning device for acting on the pressure releasing device to thereby return the pair of pressure contact members to their pressure contact state after a single-sheet feeding is terminated when the sheets are fed with the pair of pressure contact members pressure-released by the pressure releasing device.

6 Claims, 12 Drawing Sheets

SHEET FEEDING APPARATUS, IMAGE READING APPARATUS AND IMAGE FORMING APPARATUS

BACKGROUND OF THE INVENTION

1. Field of the Invention

This invention relates to a sheet feeding apparatus for feeding sheets one by one, and more particularly to a sheet feeding apparatus for use in an image forming apparatus such as a copier, a facsimile apparatus, a printer or a scanner.

2. Related Background Art

In an image forming apparatus such as a facsimile apparatus, a separation feed portion for sequentially feeding originals one by one to an image reading portion for reading images is of a construction in which the release of the pressure contact of a separation pad brought into pressure contact with a separation roller for feeding originals on a stocking plate and separating the originals is possible, and is designed such that the pressure contact of the separation pad is not released in the case of plural-sheets feeding in which a plurality of originals are set and fed one by one, and the pressure contact of the separation pad can be released in the case of one-sheet feeding in which an original is set and fed. The pressure contact of this separation pad and the release of the pressure contact are designed to be manually effected.

In the above-described example of the conventional art, however, there has been the problem that if the pressure contact of the separation pad is released when one-sheet feeding of original is effected, and if a plurality of originals are set and fed with this separation pad of which the pressure contact has been released forgotten to be returned to its pressure contact position, the plurality of originals are all conveyed at once. Also, there has been the possibility that at that time, an inconvenience such as the jam of the originals occurs to an original conveying system.

SUMMARY OF THE INVENTION

So, it is the object of the present invention to prevent the return of pressure-released separating means to its pressure contact position from being forgotten, and prevent the occurrence of an inconvenience such as bad conveyance.

The present invention has been made in view of the above-noted situation, and the typical construction of the present invention for achieving the above object is a sheet feeding apparatus having a stocking plate on which a plurality of sheets are stackable, separating means for separating the sheets stacked on the stocking plate one by one by a pair of pressure contact members, feeding means for feeding the sheets, and pressure releasing means for releasing the pressure contact of the pair of pressure contact members, and having returning means for acting on the pressure releasing means to thereby return the pair of pressure contact members to their pressure contact state after the feeding of a sheet has been terminated when the sheets are fed with the pair of pressure contact members released from their pressure by the pressure releasing means.

According to the above-described construction, forgetting to return the pressure contact members to their pressure contact position after one-sheet feeding effected in the pressure-released state of the separating means by the pressure releasing means has been terminated can be prevented, and an inconvenience such as the bad conveyance of sheets caused by the forgetting to return can be prevented, and the usability and quality of the apparatus are markedly improved.

DESCRIPTION OF THE PREFERRED EMBODIMENTS

Some embodiments of a sheet feeding apparatus to which the present invention is applied will hereinafter be specifically described with reference to the drawings. In the following description, a sheet feeding apparatus in an image forming apparatus such as a copier or a facsimile apparatus is exemplified.

[First Embodiment]

A sheet feeding apparatus and an image forming apparatus according to a first embodiment will hereinafter be described in detail with reference to the drawings. In the present embodiment, a facsimile apparatus is exemplified as the image forming apparatus, and an original conveying portion in the image reading portion of the facsimile apparatus is exemplified as the sheet feeding apparatus to which the present invention is applied.

Hereinafter, as the order of description, the construction of the facsimile apparatus as the image forming apparatus will first be schematically described, and next the construction and operation of an original conveying portion as the sheet feeding apparatus to which the present invention is applied will be described.

Figure 12:
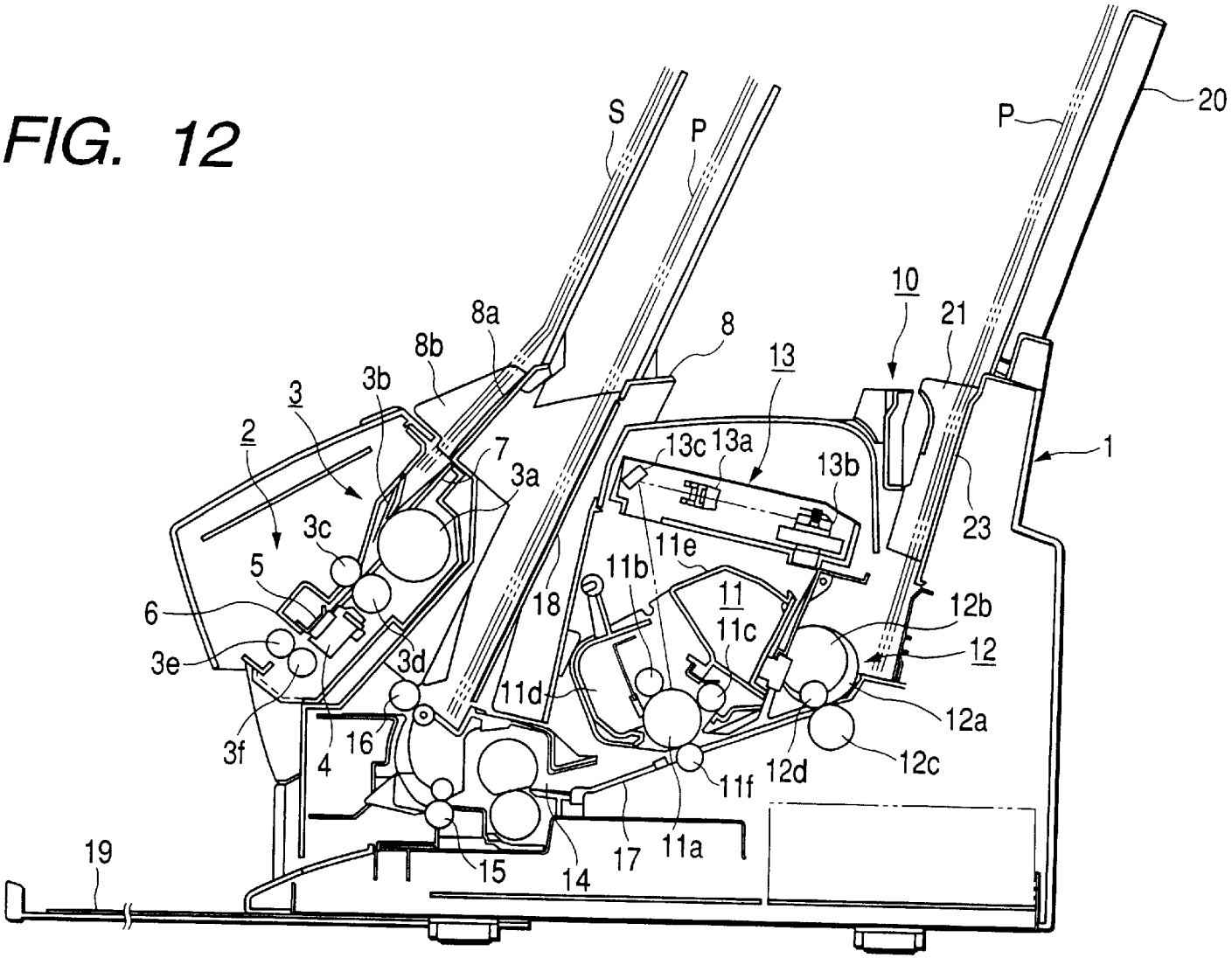
FIG. 12 is a typical cross-sectional view schematically showing the construction of a facsimile apparatus according to the present invention.

Reference is first had to FIG. 12 to schematically describe the construction of the facsimile apparatus. FIG. 12 is a typical cross-sectional view schematically showing the construction of the facsimile apparatus according to the present embodiment. In FIG. 12, the reference numeral 1 designates the main body of the apparatus which is comprised of an image reading portion 2 for reading the images of originals S as sheets to be read, and an image recording portion 10 for recording the images on recording sheets P as sheets such as recording paper.

The image reading portion 2 has an upper surface cover 8 having an original stocking plate 8*a* on which a plurality of originals S are stackable, a close contact type image sensor 4 as reading means for reading the images of the originals S, original urging means 5 for urging the originals S against the close contact type image sensor 4, an original conveying portion for sequentially feeding the originals S stacked on the original stocking plate 8*a* one by one and conveying the originals S through the close contact type image sensor 4, and an upper original guide 6 and a lower original guide 7 forming the conveyance path of the originals S.

The upper surface cover 8 having the original stocking plate 8*a* is openably-closably mounted to the main body 1 of the apparatus so that the interchange of a cartridge and the clearance of jamming which will be described later can be done easily. Also, a slider 8*b* slidable in a widthwise direction orthogonal to the conveyance direction of the originals S is provided on the original stocking plate 8*a,* and the opposite ends of the originals S stacked on the original stocking plate 8*a* can be jogged by this slider 8*b.*

Also, the close contact type image sensor 4 as the reading means applies light from an LED array as a light source to the image information surface of the original S, and images the reflected light (image light) reflected by the image information surface on a sensor element by a SELFOC lens (registered trademark), thereby reading the image information.

The original conveying portion 3 as the sheet feeding apparatus to which the present invention is applied will be described later in detail.

The image recording portion 10 has a recording sheet stacking portion 23 stacking thereon recording sheets P as sheets for recording, a recording sheet feeding portion 12 for sequentially feeding the recording sheets P one by one from the recording sheet stacking portion 23, an image forming portion 11 for recording and forming the images on the fed recording sheets P, a laser scanner 13 for applying a laser beam (image light) as image information to the image forming portion 11, a common use discharge tray 19 for stacking and holding thereon the originals S discharged after the completion of reading and the recording sheets P discharged after the completion of recording, a recording sheet discharge plate 18 for stacking and holding thereon the recording sheets P U-turn-discharged after the recording, and a conveying guide 17 for guiding and supporting the conveyed recording sheets P.

The recording sheet feeding portion 12 is such that when feeding is started, the recording sheets P brought into pressure contact with the separation roller 12*b* are separated one by one by this separation roller 12*b* and a separation pad 12*a* in pressure contact therewith, whereafter the recording sheet P is conveyed between the photosensitive drum 11*a* and transferring means 11*f* of the image forming portion 11 by a conveying roller 12*c* and a conveying runner 12*d* urged against it and rotated by it, in timed relationship so that the leading end of an image (toner image) formed by the image forming portion 11 and the leading end of the recording sheet P may be registered with each other.

A slider 21 slidable in the widthwise direction orthogonal to the conveyance direction of the recording sheets P is provided on the recording sheet stacking portion 23, and the opposite ends of the recording sheets P stacked on the recording sheet stacking portion 23 can be jogged by this slider 21.

The recording sheet stacking portion 23 can stack a plurality of recording sheets P thereon, and in the present embodiment, the number of recording sheets which can be set thereon is about 100 sheets. Further, the sizes of the recording sheets which can be stacked and set on the recording sheet stacking portion 23 are three sizes, i.e., A4 size, letter size and legal size.

In the present invention, however, the number of recording sheets which can be set and the sizes of the recording sheets which can be stacked and set are not limited to those mentioned above, but a suitable construction can be adopted as required.

In the image forming portion 11, a laser beam which is an image signal is first emitted from the laser beam emitter 13*a* of the laser scanner 13 on the basis of the image signal. This laser beam is applied to the photosensitive drum 11*a* of the image forming portion 11 by a polygon mirror 13*b* and a turn-back mirror 13*c,* and an image is formed on the surface of the photosensitive drum 11*a.*

In the image forming portion 11, the photosensitive drum 11*a* is incorporated in a frame with charging means 11*b,* developing means 11*c* and cleaning means 11*d* as process means acting thereon to thereby constitute a process cartridge 11*e,* which is detachably mountable to the main body 1 of the apparatus. Accordingly, during the aforedescribed image formation, the laser beam may be applied from the laser scanner 13 to the surface of the photosensitive drum 11*a* uniformly charged by the charging means 11*b,* whereby a latent image is formed thereon, and this latent image may be made into a visible image (toner image) by a toner supplied from the developing means 11*c.*

Also, in the image forming portion 11, the transferring means 11*f* for transferring the toner image formed on the surface of the drum to the recording sheet P is disposed on the peripheral portion of the photosensitive drum 11*a,* and fixing means 14 for fixing the transferred toner image on the recording sheet P is disposed in the recording sheet conveyance path downstream of the photosensitive drum 11*a.* In FIG. 12, the reference numerals 15 and 16 designate pairs of discharge rollers.

Accordingly, the recording sheet P fed from the recording sheet stacking portion 23 in timed relationship with the image forming portion 11 may be conveyed to the fixing means 14 along a conveying guide 17 after the toner image formed on the surface of the photosensitive drum 11*a* has been transferred thereto by the transferring means 11*f,* and may have the toner image thereon fixed by the fixing means 14, and may be discharged to the common use discharge tray 19 by the pair of discharge rollers 15 or to a recording sheet discharge plate 18 by the pair of discharge rollers 16 through a U-turn path.

When jam occurs during recording, the upper surface cover 8 having the original stocking plate 8*a* can be opened to thereby easily clear of the recording sheet P stagnating in the interior of the apparatus.

Figure 1:
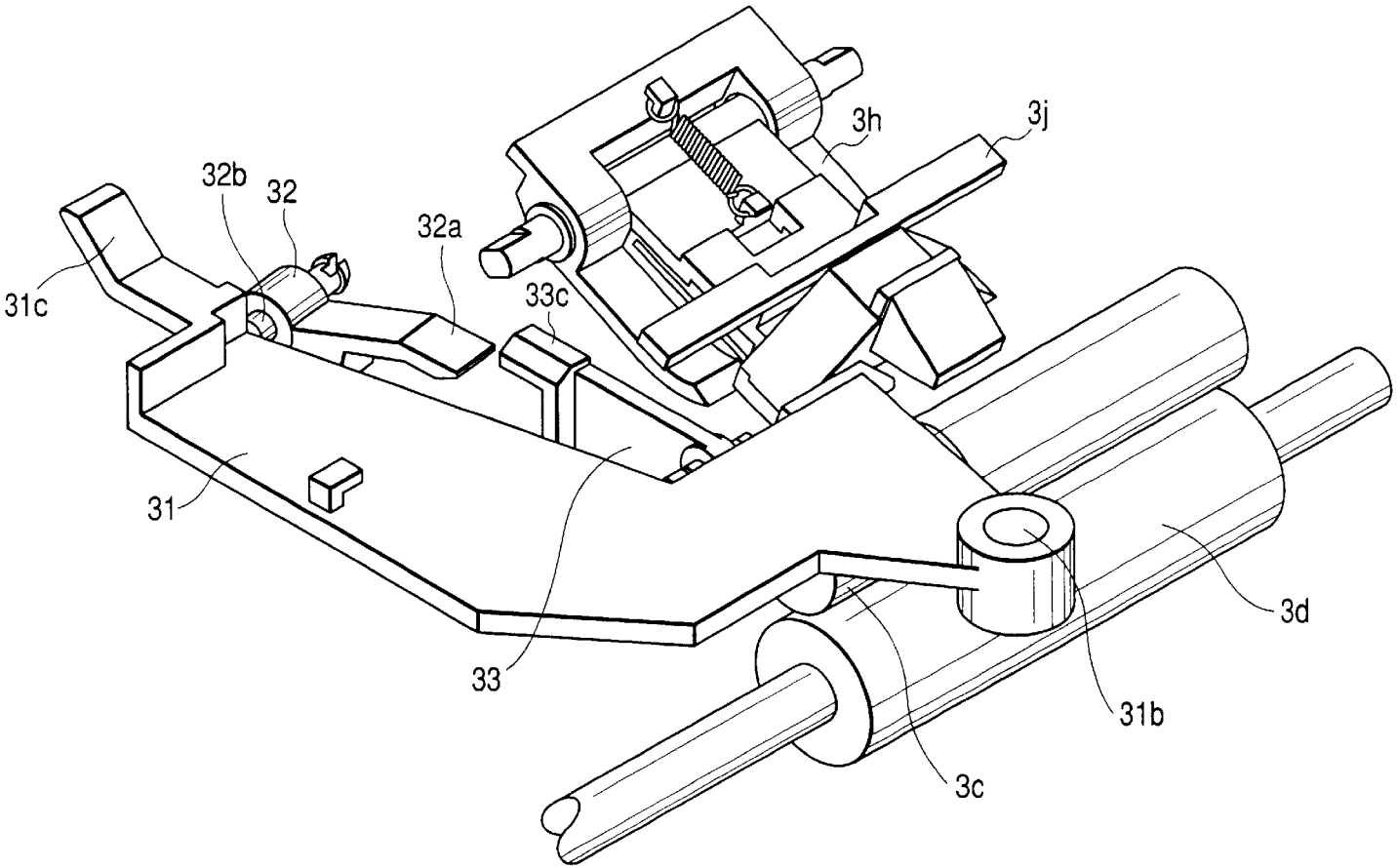
FIG. 1 is a perspective view of the essential portions of an original conveying portion in an image reading portion according to the present invention.
Figure 2A:
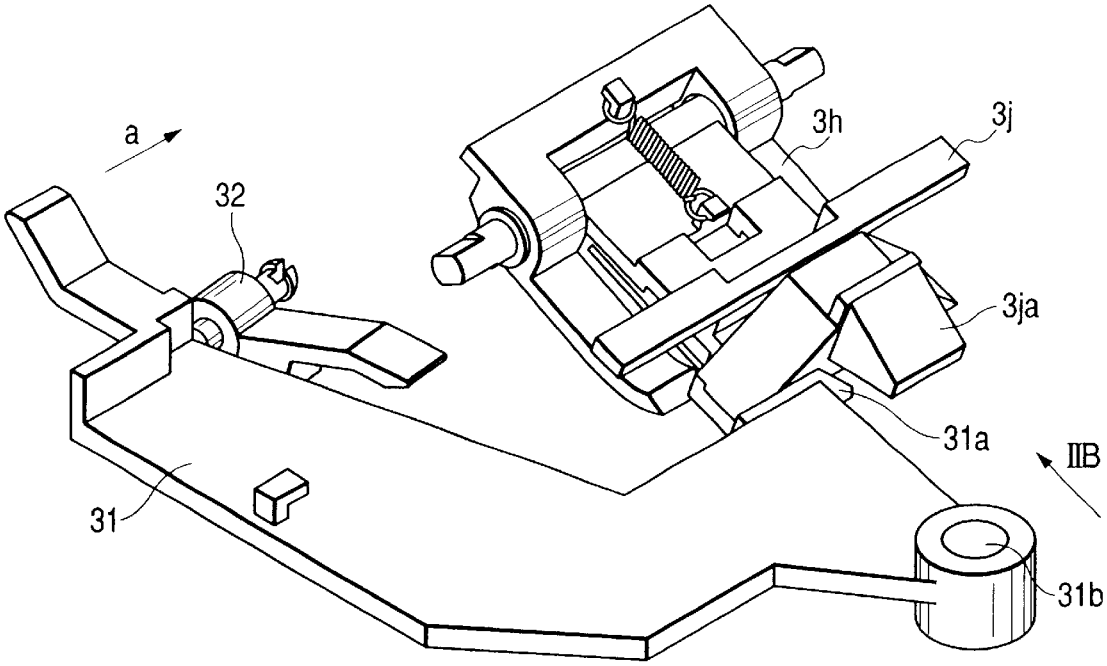
FIG. 2A is a perspective view of the essential portions of the original conveying portion in the image reading portion according to the present invention.
Figure 2B:
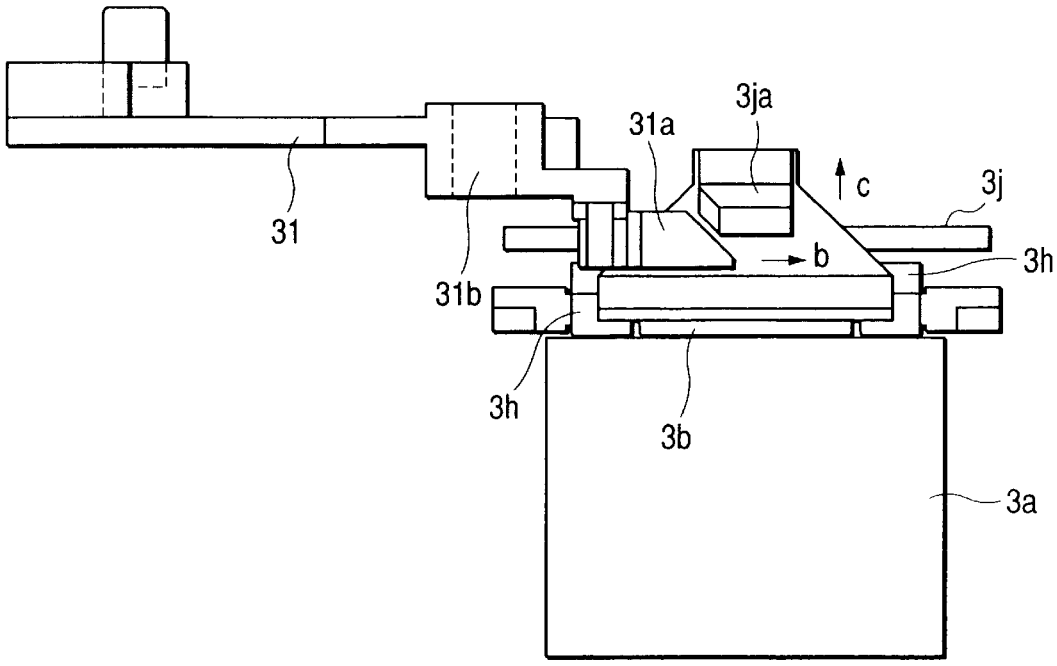
FIG. 2B is a view looking in the direction of arrow IIB of FIG. 2A.
Figure 3:
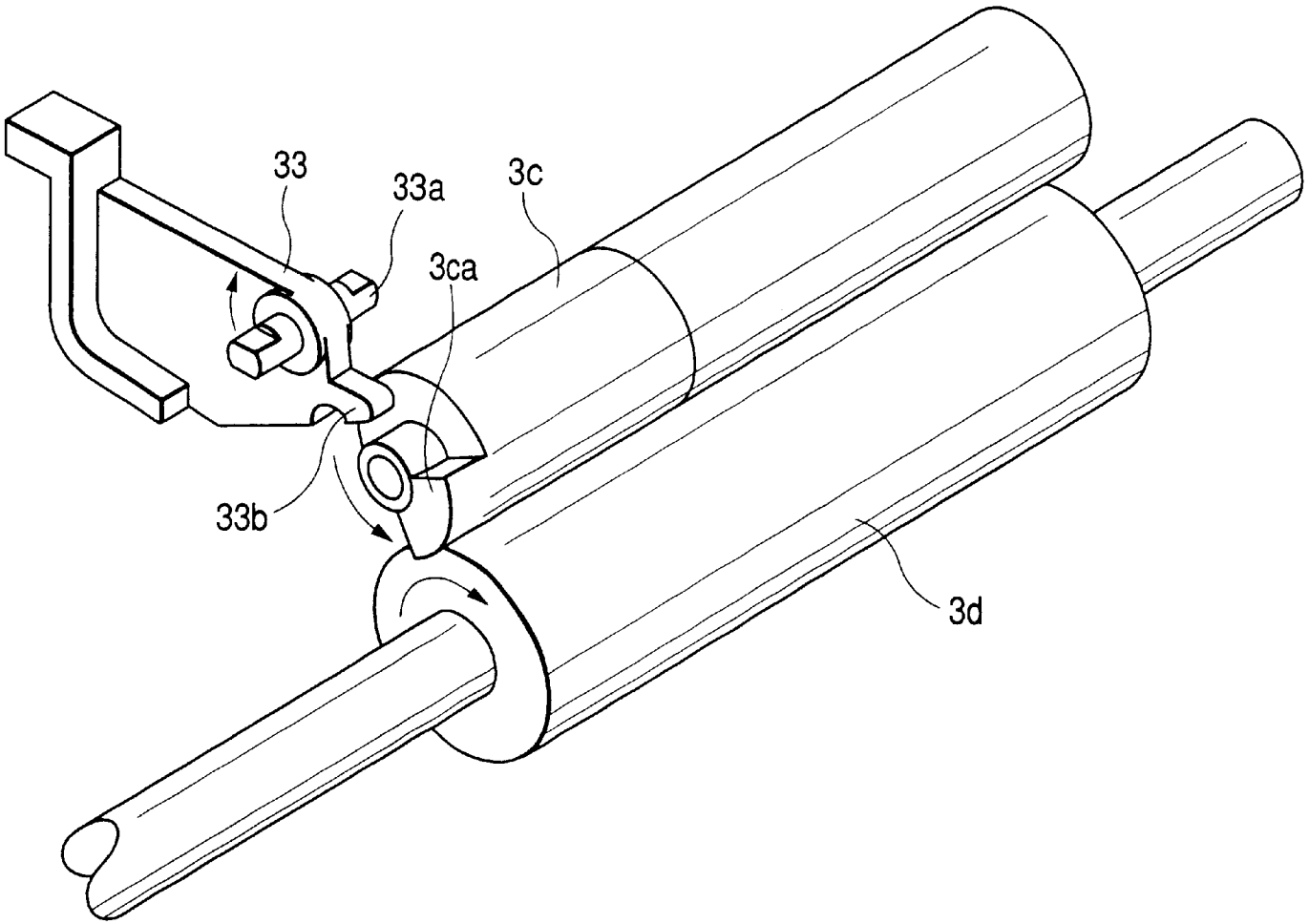
FIG. 3 is a perspective view showing the construction of a stopper portion in the original conveying portion according to the present invention.
Figure 4:
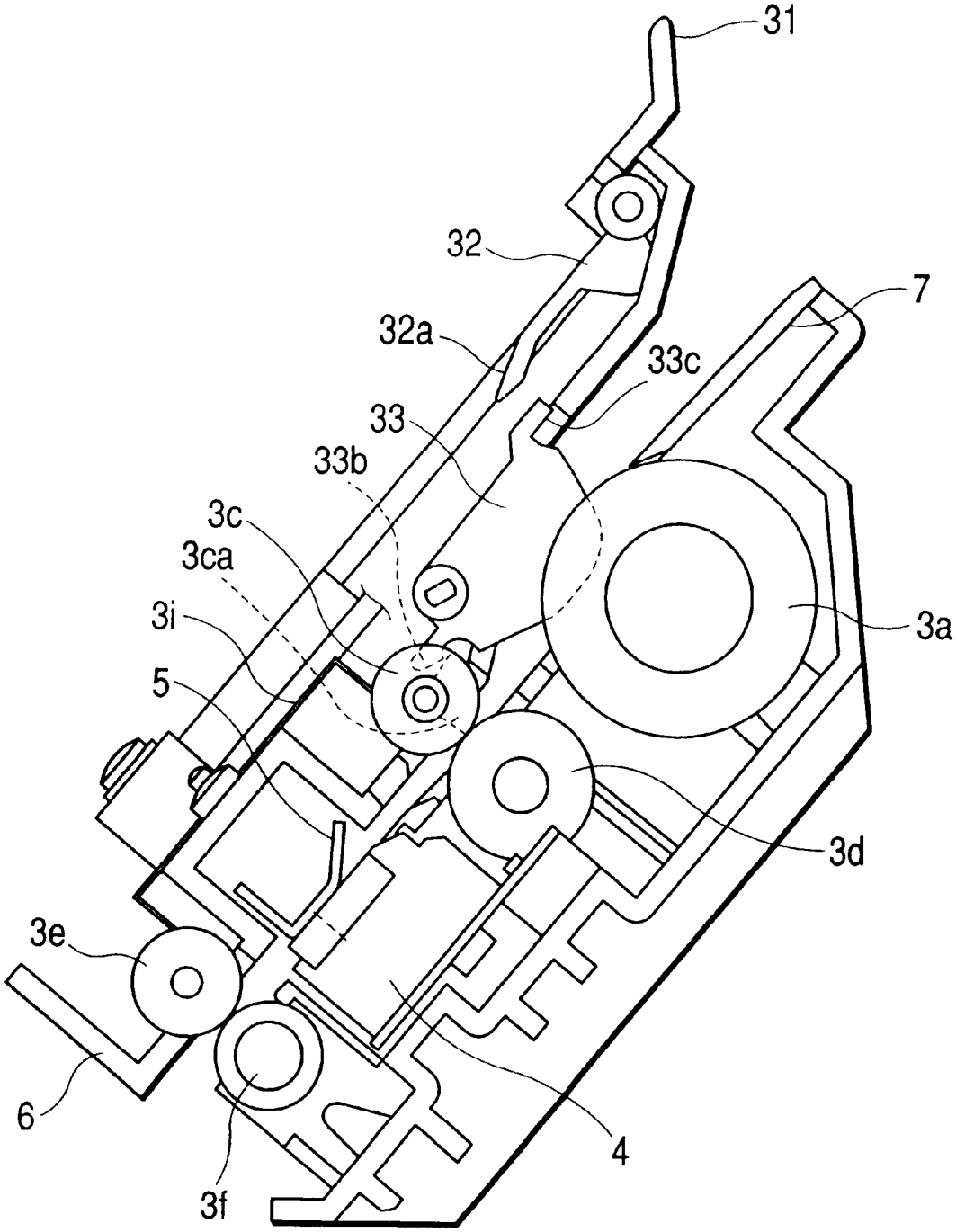
FIG. 4 shows the construction of the essential portions of the original conveying portion in the image reading portion according to the present invention.
Figure 5:
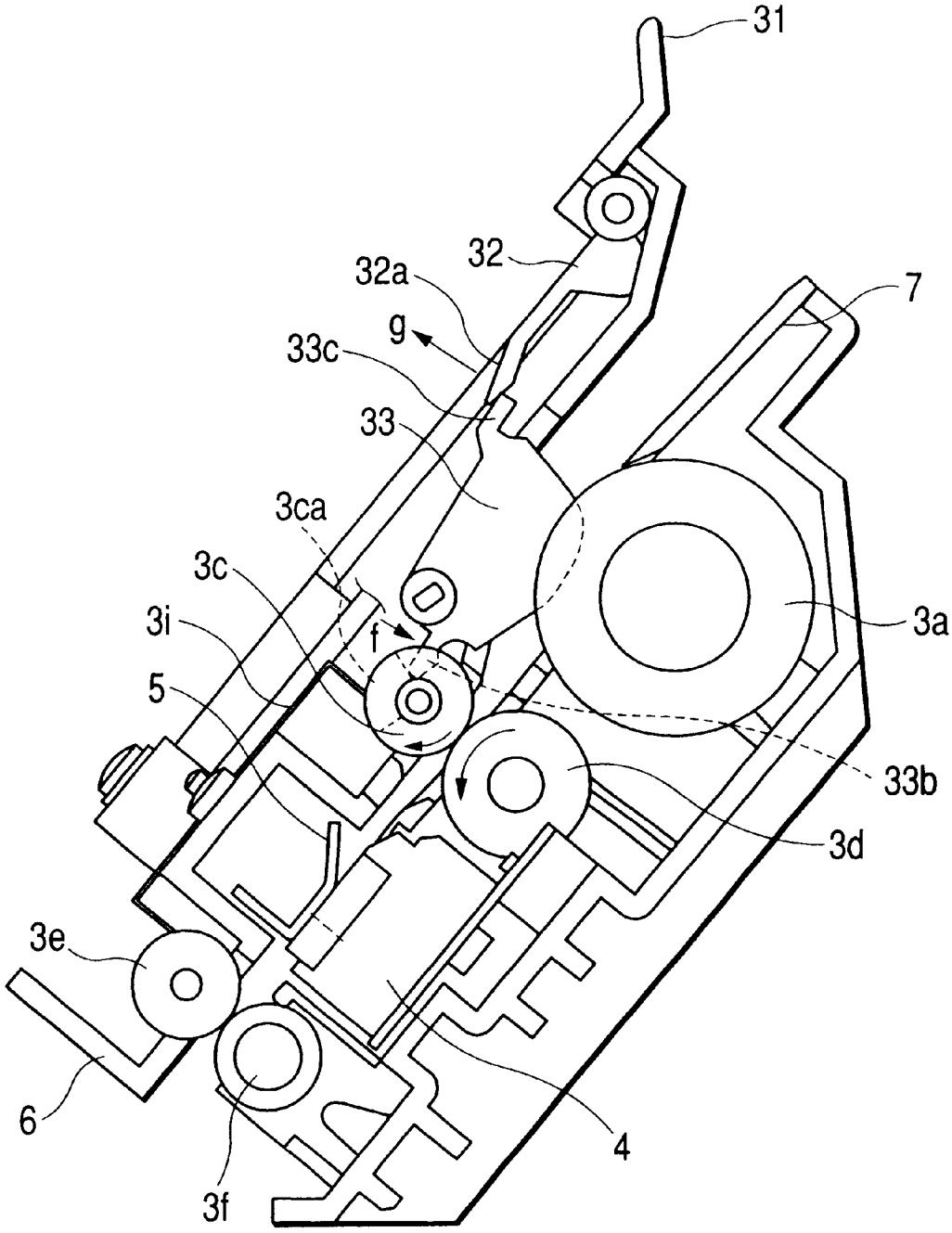
FIG. 5 shows the construction of the essential portions of the original conveying portion in the image reading portion according to the present invention.
Figure 6:
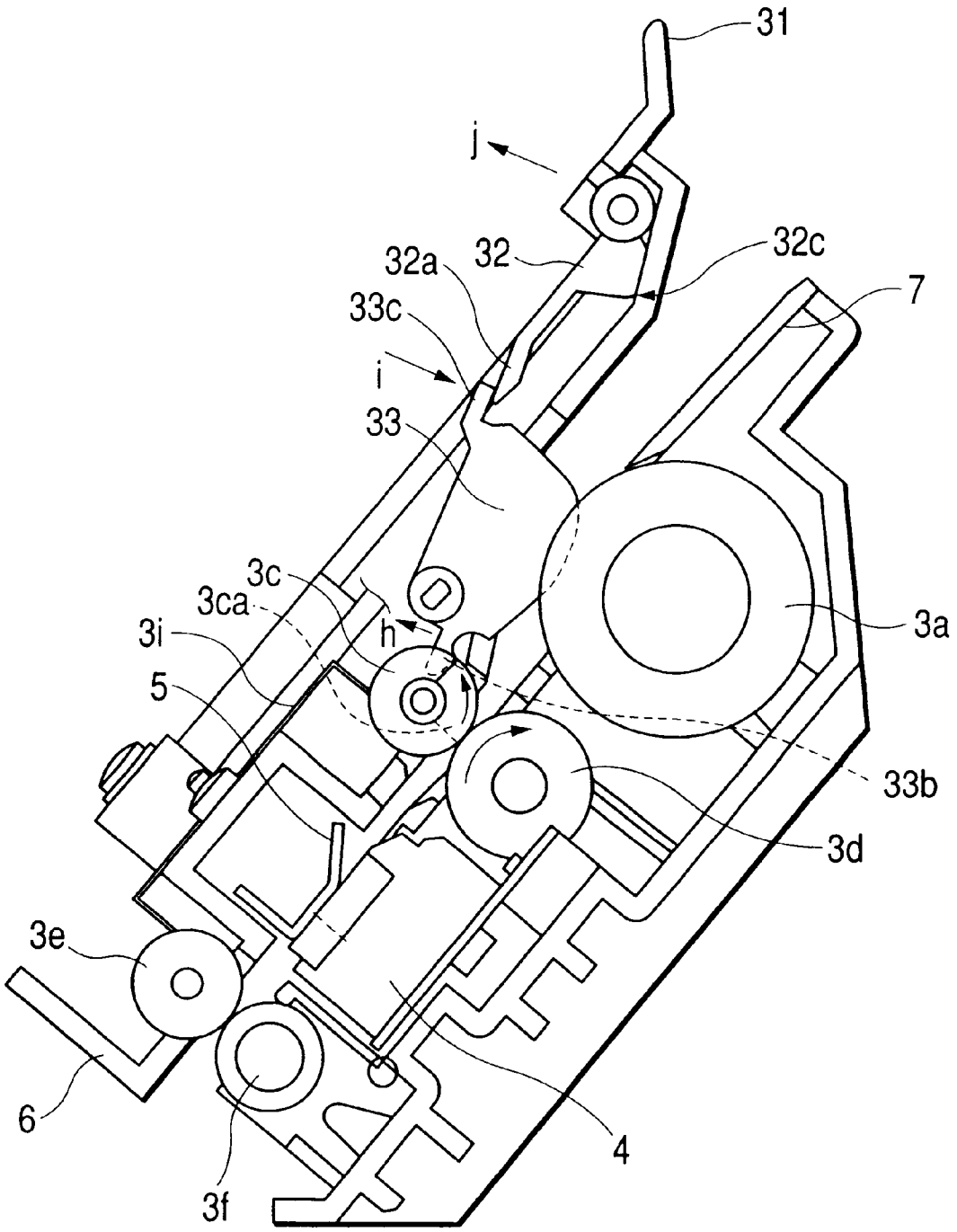
FIG. 6 shows the construction of the essential portions of the original conveying portion in the image reading portion according to the present invention.
Figure 7:
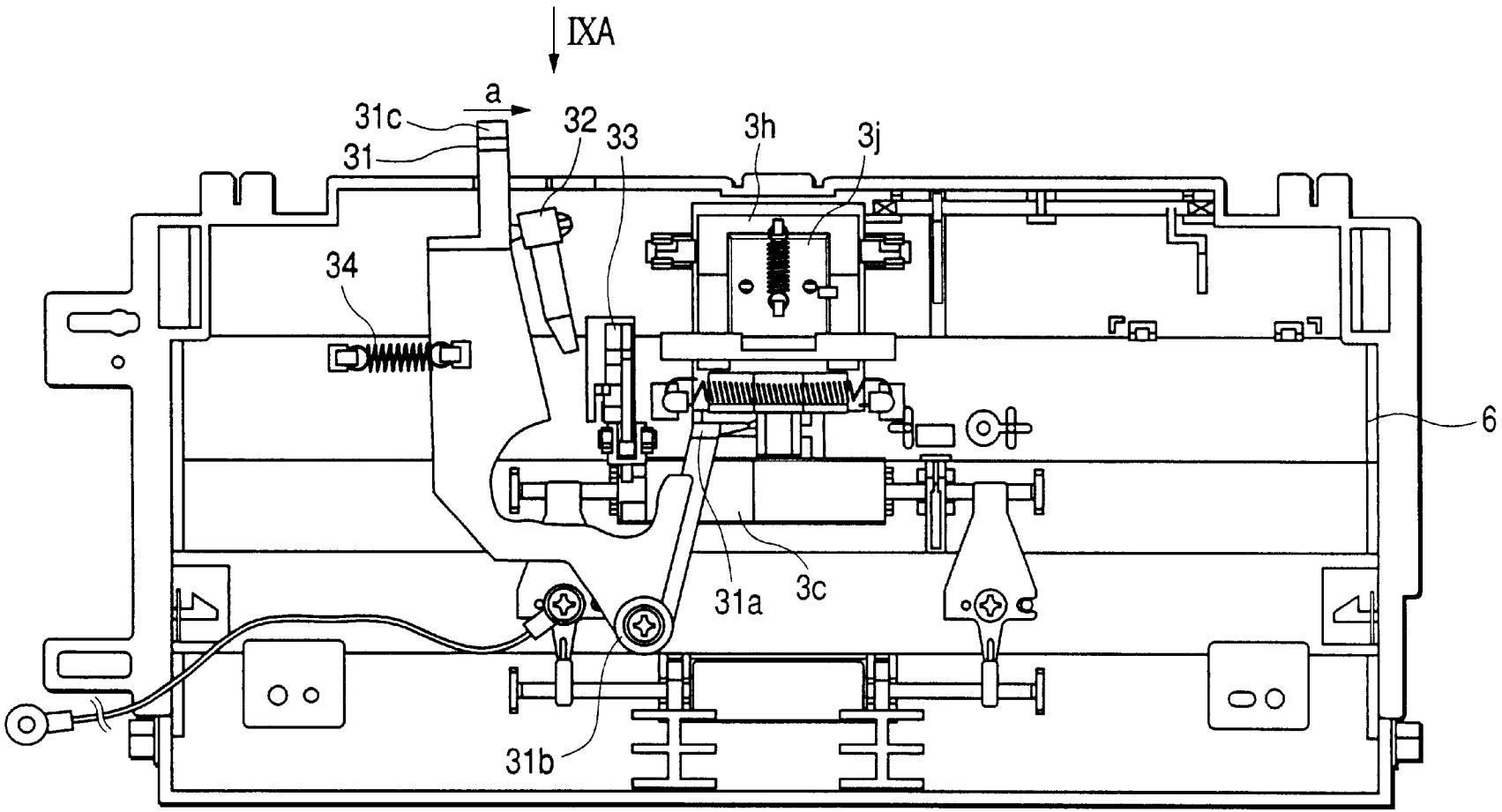
FIG. 7 is a top plan view of an upper original guide unit.
Figure 8:
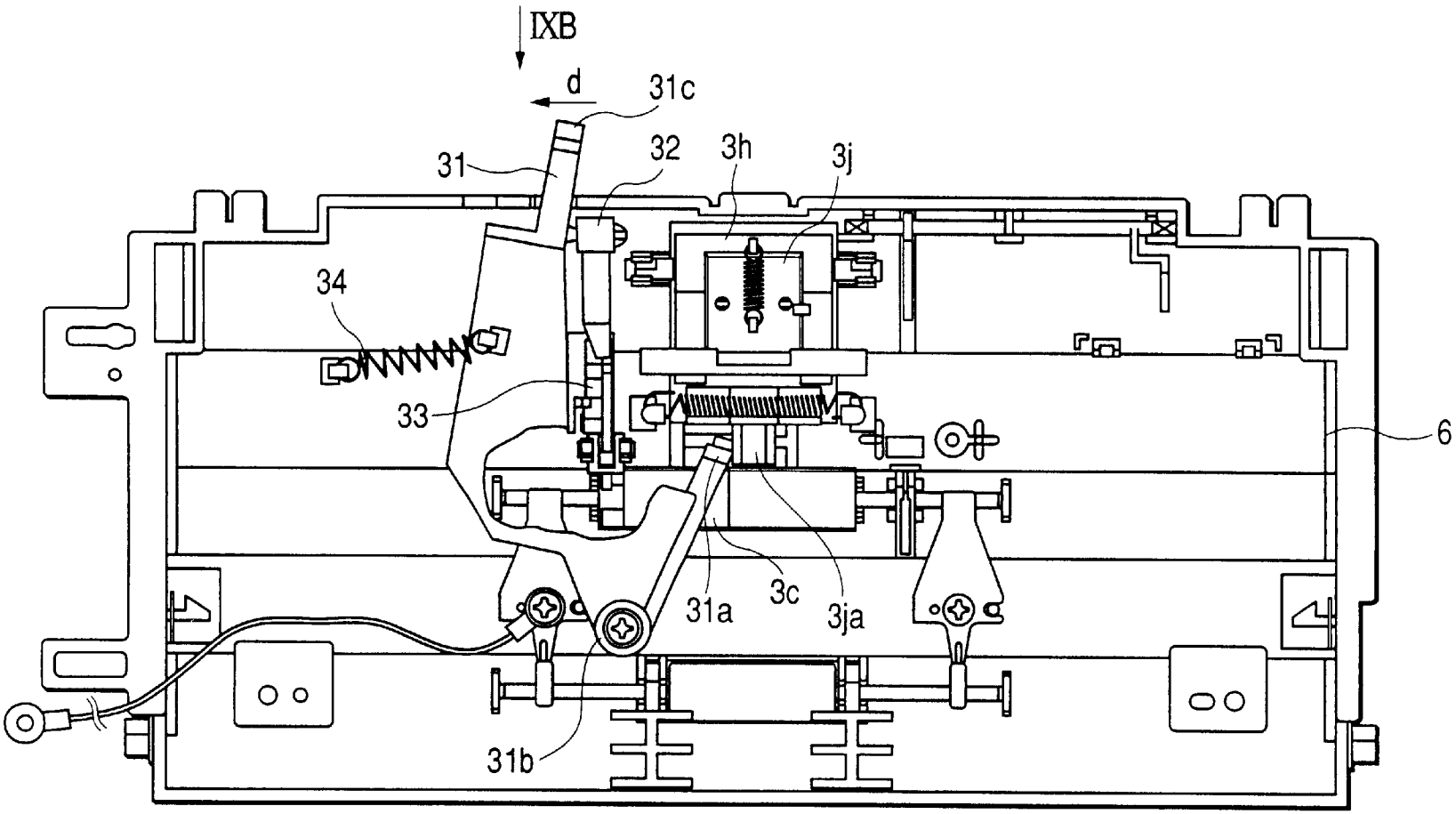
FIG. 8 is a top plan view of the upper original guide unit.
Figure 9A:
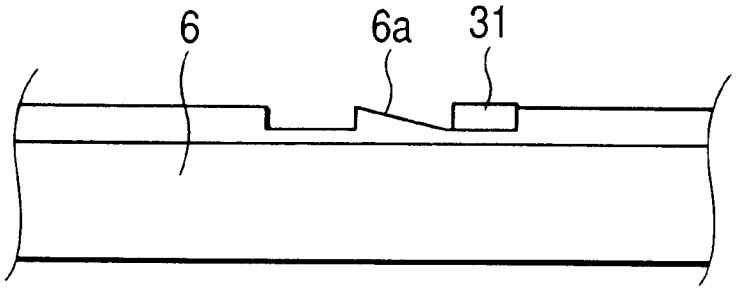
FIGS. 9A and 9B show the construction of the essential portions of the changeover portion of a pressure releasing lever in the original conveying portion according to the present invention.
Figure 9B:
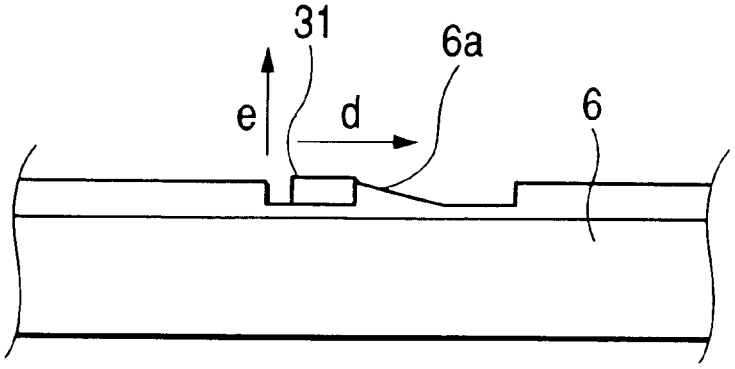
Figure 10:
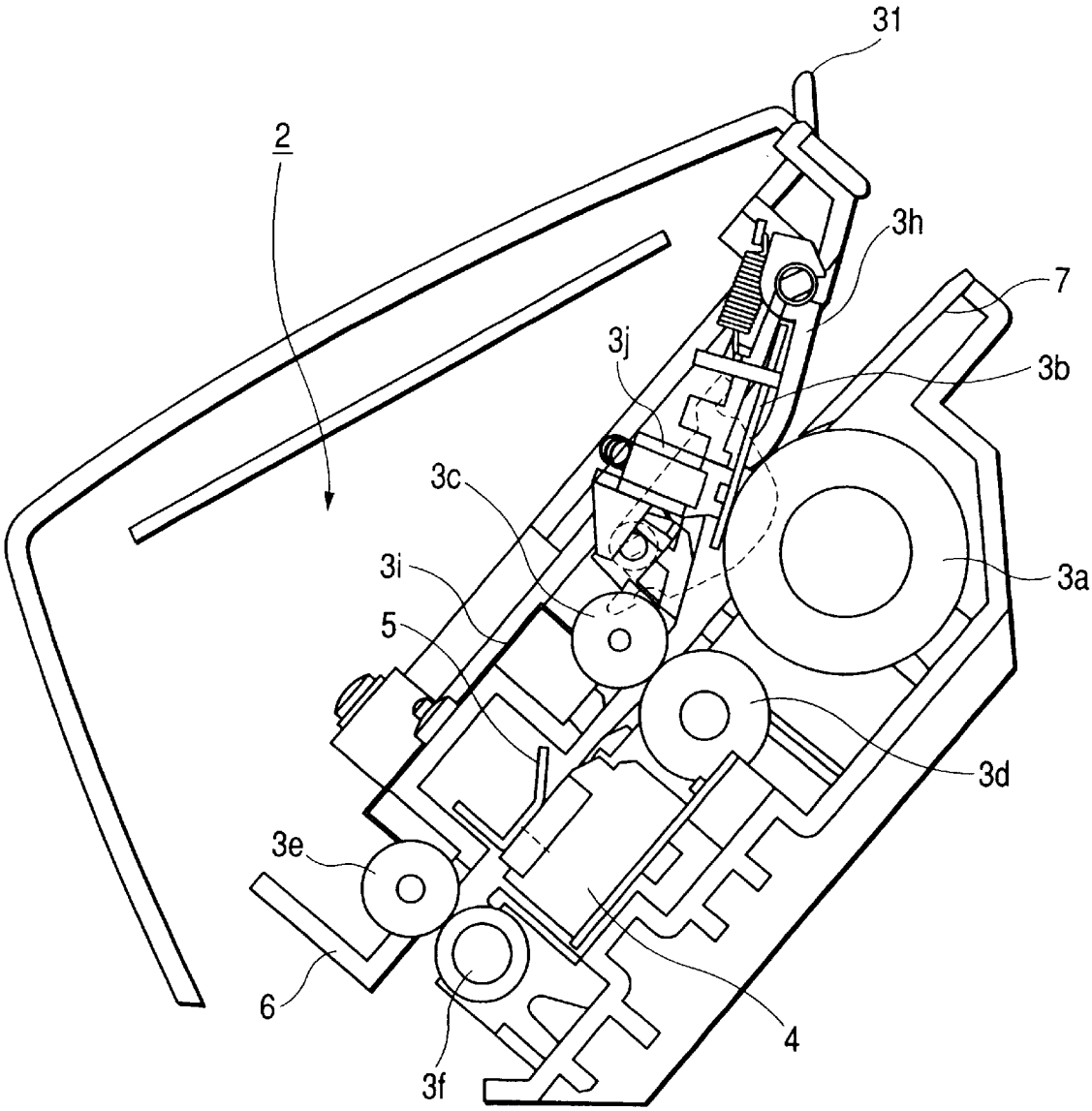
FIG. 10 shows the pressure contact state of separating means in the present invention.
Figure 11:
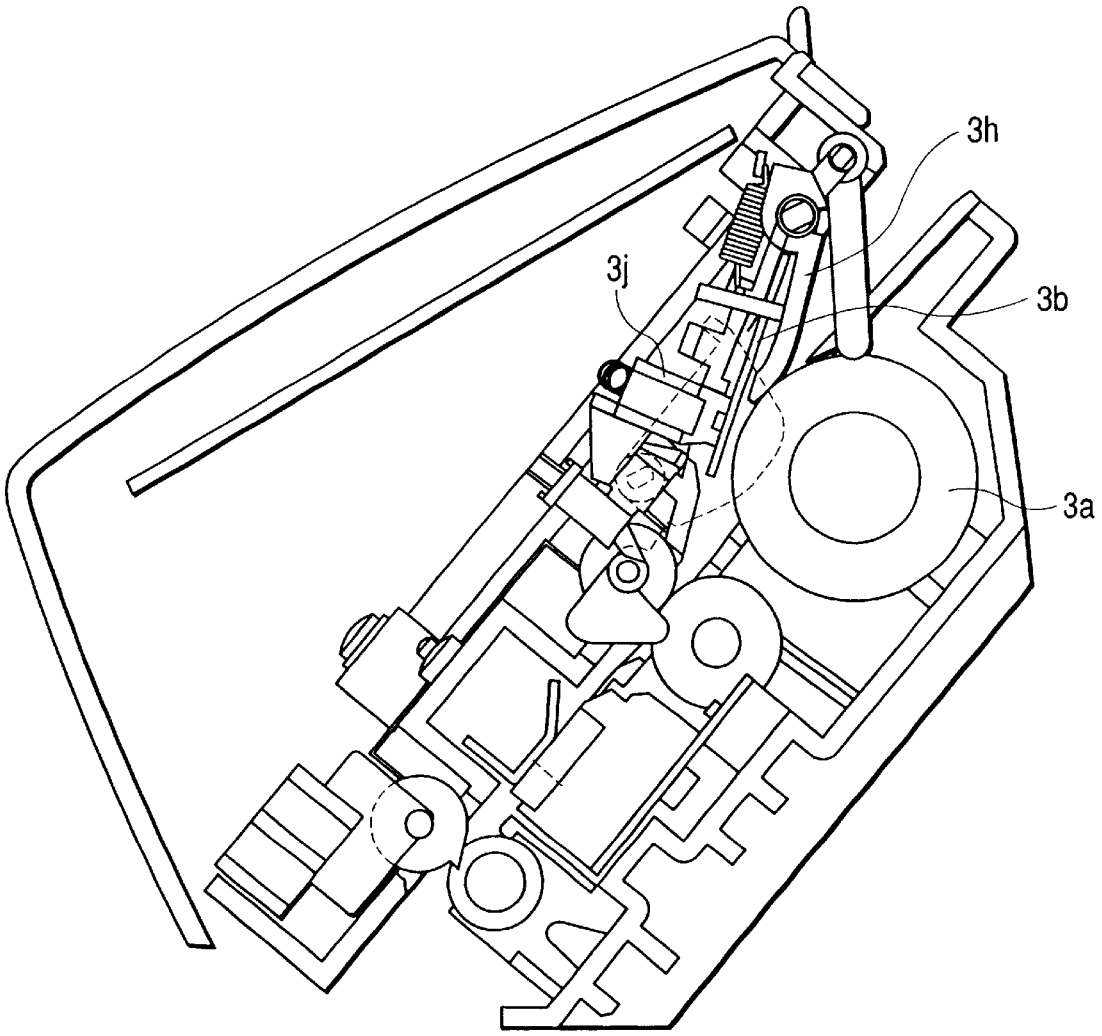
FIG. 11 is a cross-sectional view showing the present invention.

Reference is now had to FIGS. 1 to 11 to describe in detail the construction and operation of the original conveying portion 3 to which the present invention is applied. FIGS. 1, 2A and 2B are perspective views of the essential portions of the original conveying portion in the image reading portion, FIG. 3 is a perspective view showing the construction of a stopper portion in the original conveying portion, FIGS. 4 to 6 show the constructions of the essential portions of the original conveying portion in the image reading portion, and FIGS. 7 and 8 are top plan views of an upper original guide unit. FIGS. 9A and 9B show the constructions of the essential portions of the changeover portion of a pressure releasing lever in the original conveying portion, FIG. 10 is a cross-sectional view showing the pressure contact state of a separating portion, and FIG. 11 is a cross-sectional view showing the pressure contact released state of the separating portion.

In FIGS. 1, 2A and 2B, and 10, the reference numeral 31 designates a pressure releasing lever which is pressure releasing means for a separation pad 3*b*, and it is for releasing the pressure contact of the separation pad 3*b* which is in pressure contact with a separation roller 3*a*. The separation roller 3*a* and the separation pad 3*b* together constitute a pair of pressure contact member, and the separating operation is performed by the action of these members. A pressure releasing lever 31 is pivotally movable about the center of rotation 31*b*. Also, an initializing lever 32 as a lever member pivotally movable in operative association with the changeover of regulating means which will be described later is mounted on the pressure releasing lever 31 for rotation about the center of rotation 32*b*. The reference numeral 33 denotes a stopper as regulating means, and it is for regulating the leading ends of the originals S placed on the stocking plate 8*a*. The reference character 3*c* designates a feed runner, and the reference character 3*d* denotes a feed roller, and these rollers together constitute feeding means. The reference numeral 3*h* designates a preliminary pressure contact arm disposed so as to abut against the separation roller 3*a* on the widthwisely opposite sides of the separation pad 3*b* and on the upstream side with respect to the sheet conveyance direction. The reference character 3*j* denotes a separation pad holder for holding the separation pad 3*b*, and it is movable with the separation pad 3*b*.

The position shown in FIG. 7 is the initial position of the pressure releasing lever 31, i.e., the position when the separation pad 3*b* is in pressure contact. When a user holds an operating portion 31*c* and moves the pressure releasing lever 31 in the direction indicated by the arrow a in FIG. 7, there is brought about a state as shown in FIG. 8, i.e., a state in which the pressure contact of the separation pad 3*b* which is in pressure contact with the separation roller 3*a* has been released. At this time, the pressure releasing lever 31 receives a force with which it is returned in the direction indicated by the arrow d in FIG. 8 by a spring 34. While in the present embodiment, a tension spring is used as the spring 34, this is not restrictive, but of course, for example, a compression spring, a leaf spring or the like may also be used.

When seen in FIGS. 9A and 9B which are views looking in the directions of arrows IXA and IXB in FIGS. 7 and 8, the state shown in FIG. 9A is the initial position of the pressure releasing lever 31 which is a state in which the separation pad 3*b* is in pressure contact, and the state shown in FIG. 9B is a state in which the pressure contact of the separation pad 3*b* has been released. The pressure releasing lever 31 moved to a pressure-releasing position, as shown in FIG. 9B, is restrained by a projected portion 6*a* provided on the upper original guide 6, and is locked in the pressure-releasing position against the force of restitution of the spring 34. When from this state as shown in FIG. 9B, the pressure releasing lever 31 receives a force in the direction indicated by the arrow e in FIG. 9B by the initializing lever 32, the pressure releasing lever 31 may become disengaged from the projected portion 6*a* of the upper original guide 6 and be returned in the direction indicated by the arrow d in FIG. 9B by the force of restitution of the spring 34.

Also, as can be seen from FIGS. 2A and 2B, when the pressure releasing lever 31 is moved in the direction indicated by the arrow a in FIG. 2A, this pressure releasing lever 31 moves in the direction indicated by the arrow b in FIG. 2B and the slope portion of the engagement portion 31*a* of the pressure releasing lever 31 raises the engagement portion 3*ja* of a separation pad holder 3*j* in the direction indicated by the arrow c in FIG. 2B, whereby the pressure contact of the separation pad 3*b* with the separation roller 3*a* is released. Although at this time, the pressure contact of the separation pad 3*b* with the separation roller 3*a* is released, the preliminary pressure contact arm 3*h* remains brought into pressure contact with the separation roller 3*a*. FIG. 11 shows a state in which the pressure contact of the separation pad 3*b* has been released. While the separation pad holder 3*j* and the separation pad 3*b* are separate from the separation roller 3*a*, the preliminary pressure contact arm 3*h* remains brought into pressure contact with the separation roller 3*a*.

Reference is now had to FIGS. 3 to 6 to describe the epitome of the automatic initializing operation from the pressure-released state of the separation pad 3*b*.

Here, reference is first had to FIG. 3 to briefly describe the movement of the stopper 33 which is regulating means for regulating the leading end of the original to a regulating position and a regulation releasing position and the operation of returning it to an initial state (initializing operation).

The initializing operation of the stopper 33 is the operation of lowering the stopper 33 by utilizing the reversely rotating operation of a driving motor for the feed roller 3*d* after the completion of the conveyance of the original, and making the stopper 33 wait in its lowered state. The construction is such that when the driving motor is rotated in a direction opposite to the direction indicated by the arrows (conveyance direction) as shown in FIG. 3, the projection (liberating source) 3*ca* of the feed runner 3*c* abuts against and is regulated by the lower portion of the projection 33*b* of the stopper 33, and the feed roller 3*d* and the feed runner 3*c* slide to thereby return the stopper 33 to its initial state (regulating position) which is the lowered state.

On the other hand, the movement of the stopper 33 to the regulation releasing position is such that the feed roller 3*d* rotates in the original conveying direction and the feed runner 3*c* with the liberating source 3*ca* is rotated therewith, and the projection 3*ca* of this feed runner 3*c* abuts against the upper portion of the projection 33*b* of the stopper 33 and in accordance therewith, the stopper 33 rotates about a shaft 33*a* in the direction indicated by the arrow (FIG. 3) and upwardly retracts (releases the regulation).

The automatic initializing operation from the pressure-released state of the separation pad 3*b* is performed by the use of the changeover operation of this stopper 33.

FIG. 4 shows the state of the stopper 33 during the pressure release of the separation pad 3*b* shown in FIGS. 8 and 11. When the conveyance of the original is started, as shown in FIG. 5, the feed roller 3*d* begins to be rotated in the direction indicated by the arrow and therewith, the feed runner 3*c* with the liberating source is rotated in the direction indicated by the arrow, and the stopper 33 rotates in the direction indicated by the arrow f. At this time, the distal end of the stopper 33 rotates and rises in the direction indicated by the arrow g to thereby raise the arm portion 32*a* of the initializing lever 32, and as shown in FIG. 6, the up-down relation between the arm portion 33*c* of the stopper 33 and the arm portion 32*a* of the initializing lever 32 is reversed.

When the motor is reversely rotated after the termination of the reading of the original, the feed roller 3*d* is rotated in the direction indicated by the arrow in FIG. 6. Therewith, the feed runner 3*c* with the liberating source is rotated in the direction indicated by the arrow, and the projection 33*b* of the stopper 33 rotates in the direction indicated by the arrow h. At this time, the arm portion 33*c* of the stopper 33 depresses the arm portion 32*a* of the initializing lever 32 in the direction indicated by the arrow i. With the portion of contact 32*c* between the initializing lever 32 and the upper original guide 6 as a fulcrum, the pressure releasing lever 31 is pushed up in the direction indicated by the arrow j by the principle of lever. When this push-up of the pressure releasing lever 31 exceeds the projected portion 6*a* shown in FIG. 9B, the pressure releasing lever 31 may be returned in the direction indicated by the arrow d in FIG. 9B by the force of restitution of the spring 34.

As described above, the initialization (return to the initial position) of the pressure releasing lever 31 for the separation pad 3*b* can be accomplished by a very simple and low-cost construction. Thereby, forgetting to return the separation pad 3*b* to its pressure contact position after one-sheet feeding of the original S effected with the pressure contact of the separation pad 3*b* released by the pressure releasing lever 31 has been terminated can be prevented, and an inconvenience such as the bad conveyance of the originals S caused by this forgetting to return can be prevented, and the usability and quality of the apparatus are markedly improved.

Further, the pressure releasing lever 31 is restrained and fixed by the projected portion 6*a* when it has moved the separation pad 3*b* to the pressure-released position, and is automatically returned to its original position (initial position) by the force of restitution of the spring 34 when this restraint is released and therefore, the automatic return of the pressure releasing lever 31 can be accomplished simply and at a low cost. Also, the pressure releasing lever 31 scarcely receives the force of the spring 34 in the waiting position (the pressure contact position of the separation pad 3*b*) which is the original position and therefore, there is no possibility of creep deformation or the like.

Further, the restraint of the pressure releasing lever 31 is released through the initializing lever 32 pivotally moved in operative association with the changeover of the stopper 33, whereby the separation pad 3*b* is automatically returned to its pressure contact position, that is, the pressure releasing lever 31 is automatically returned to its original position (initial position) by the use of the principle of the lever, and therefore, a great force can be generated by small power and be used as motive power for automatic return.

As shown in FIG. 10, in the image reading portion 2, when the originals S are stacked on the original stocking plate 8*a*, the operating portion 31*c* of the pressure releasing lever 31 is moved to the right and left as shown in FIGS. 7 and 8, whereby plural-sheets feeding or one-sheet feeding is selected. After this selection, the originals S are set on the original stocking plate 8*a*. The originals S are nipped between the separation roller 3*a* and the preliminary pressure contact arm 3*h* which is in pressure contact with the separation roller 3*a*. The leading ends of the originals S strike against the stop surface of the stopper 33 which is in its initial state (regulating position) and cannot go in any further.

When the conveyance of the originals S is started after the originals S have been set in the manner described above, in the case of plural-sheets feeding, the stopper 33 is liberated by the feed runner 3*c* with the liberating source, and the originals S are fed to the separation pad 3*b* portion by the separation roller 3*a* with which the preliminary pressure contact arm 3*h* is in pressure contact. The originals S are then separated and fed one by one by the separation roller 3*a* and the separation pad 3*b* which is in pressure contact with the separation roller 3*a*. On the other hand, in the case of one-sheet feeding, the pressure contact between the separation roller 3*a* and the separation pad 3*b* is released in advance, and the stopper 33 is liberated by the feed runner 3*c* with the liberating source, and the original S is fed by the separation roller 3*a* with which the preliminary pressure contact arm 3*h* is in pressure contact, and arrives at the feed roller 3*d* portion.

The originals S are further conveyed to the close contact type image sensor 4 by the feed roller 3*d* which is in pressure contact with the feed runner 3*c* urged by the urging spring 3*i*, and the image information of the originals S is read while the originals S are sequentially line-fed while being urged into close contact with the close contact type image sensor 4 by the original urging means 5. Thereafter, the originals S may be discharged to the common use discharge tray 19 by a discharge roller 3*f* which is in pressure contact with a discharge runner 3*e* urged by the urging spring 3*i*. In the meantime, the originals S are guided by the upper original guide 6 and the lower original guide 7.

Further, after the discharge of the originals, the reversely rotating operation is performed and the stopper 33 is initialized, and in the case of one-sheet feeding, the initialization of the pressure releasing lever 31 for the separation pad 3*b* is also effected together.

According to the present embodiment, as described above, design is made such that the changeover of the stopper 33 to the regulating position and the regulation releasing position is effected by the forward and reverse rotations of the feed runner 3*c* with the liberating source, and design is also made such that the separation pad 3*b* is moved to the pressure-released position by the pressure releasing lever 31, and after the feeding of an original has been terminated, the pressure releasing lever 31 is automatically returned to its initial position (the pressure contact position of the separation pad 3*b*) which is the original position in operative association with the changeover of the stopper 33 in order to return the separation pad 3*b* to its pressure contact position and therefore, forgetting to return the separation pad 3*b* to its pressure contact position after one-sheet feeding of the original S effected in the pressure-released state of the separation pad 3*b* by the pressure releasing lever 31 has been terminated can be prevented, and an inconvenience such as the bad conveyance of the originals caused by the forgetting to return can be prevented, and the usability and quality of the apparatus are markedly improved.

[Other Embodiments]

While in the aforedescribed embodiments, a facsimile apparatus has been exemplified as the image forming apparatus, the present invention is not restricted thereto, but the image forming apparatus may be other image forming apparatus such as a copier, a printer or a scanner, and a similar effect can be obtained by applying the present invention to a sheet feeding apparatus in such image forming apparatus.

Also, while in the aforedescribed embodiment, the application of the sheet feeding apparatus for sequentially feeding sheets such as originals to be read one by one to the reading means to an image reading apparatus has been exemplified, the present invention is not restricted thereto, but the present invention can also be applied to a sheet feeding apparatus for sequentially feeding sheets such as recording paper to be recorded one by one to recording means (image forming means) to thereby obtain a similar effect.

Also, while in the aforedescribed embodiment, the electrophotographic system has been exemplified as the recording system, the present invention is not restricted thereto, but other recording system such as the ink jet system may also be adopted.

As described above, according to the present invention, forgetting to return separating means to its pressure contact position after one-sheet feeding effected in the pressure-released state of the separating means by pressure releasing means has been terminated can be prevented by a simple and low-cost construction, and an inconvenience such as the bad conveyance of sheets caused by the forgetting to return can be prevented, and the usability and quality of the apparatus are markedly improved.

What is claimed is:

1. A sheet feeding apparatus comprising:

a stacking plate on which a plurality of sheets are stackable separating means for separating the sheets stacked on said stacking plate one by one by a pair of pressure contact members;

feeding means for feeding said sheets;

pressure releasing means for releasing a pressure contact of said pair of pressure contact members, said pressure releasing means being movable between a pressure releasing position and a pressure contact position, and being designed to effect a pressure release of said pressure contact members in said pressure releasing position, and bring said pressure contact members into pressure contact with each other in said pressure contact position;

moving means for moving said pressure releasing means to said pressure contact position in operative association with a reversely rotating operation of a rotary member constituting said feeding means when said pressure releasing means is in said pressure releasing position.

2. A sheet feeding apparatus according to claim 1, wherein said rotary member is reversely rotated after a single-sheet feeding has been terminated.

3. A sheet feeding apparatus according to claim 1, further comprising: a restraining member for restraining said pressure releasing means in said pressure releasing position, wherein said moving means comprises a restraint releasing means for releasing a restraint of said pressure releasing means in operative association with a reverse rotation of said rotary member, and a spring member for returning said pressure releasing means to said pressure contact position.

4. A sheet feeding apparatus according to claim 3, wherein said restraint releasing means comprises regulating means designed to move between a position for regulating leading ends of the sheets stacked on said stacking plate and a position for releasing said regulation in operative association with a rotating operation of said rotary member, and a lever member pivotally moved in operative association with a movement of said regulating means to thereby push up said pressure releasing means and release said pressure releasing means from said restraining member.

5. An image reading apparatus comprising:

a sheet feeding apparatus as recited in any one of claims 1 to 4 for feeding sheets as originals; and reading means for reading the images of said sheets being fed.

6. An image forming apparatus comprising:

a sheet feeding apparatus as recited in any one of claims 1 to 4 for feeding sheets as recording subjects; and image forming means for forming images on said sheets being fed.

* * * * *

UNITED STATES PATENT AND TRADEMARK OFFICE

CERTIFICATE OF CORRECTION

PATENT NO. : 6,361,037 B1
DATED : March 26, 2002
INVENTOR(S) : Daigo Nakagawa

It is certified that error appears in the above-identified patent and that said Letters Patent is hereby corrected as shown below:

Column 1,
Line 32, "released" should read -- released or --.

Column 8,
Line 66, "system" (1st occurrence) should read -- systems --.

Signed and Sealed this

Fourth Day of June, 2002

*Attest:*

*Attesting Officer*

JAMES E. ROGAN
*Director of the United States Patent and Trademark Office*